US009907988B1

(12) United States Patent
Rossin et al.

(10) Patent No.: US 9,907,988 B1
(45) Date of Patent: Mar. 6, 2018

(54) POROUS METAL HYDROXIDES FOR DECONTAMINATING TOXIC AGENTS

(71) Applicant: U.S. Army Edgewood Chemical and Biological Command, Edgewood, MD (US)

(72) Inventors: Joseph A. Rossin, Columbus, OH (US); Gregory W. Peterson, Belcamp, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 38 days.

(21) Appl. No.: 14/621,604

(22) Filed: Feb. 13, 2015

(51) Int. Cl.
*A62D 3/36* (2007.01)
*A62D 101/04* (2007.01)
*A62D 101/02* (2007.01)

(52) U.S. Cl.
CPC ..... *A62D 3/36* (2013.01); *A62D 2101/02* (2013.01); *A62D 2101/04* (2013.01)

(58) Field of Classification Search
None
See application file for complete search history.

(56) References Cited

U.S. PATENT DOCUMENTS

| | | | | |
|---|---|---|---|---|
| 6,653,519 | B2 * | 11/2003 | Koper | A01N 25/06 422/28 |
| 2003/0041733 | A1 * | 3/2003 | Seguin | B01D 53/02 96/108 |
| 2003/0180213 | A1 * | 9/2003 | Carnes | B01D 15/00 423/592.1 |
| 2008/0054221 | A1 * | 3/2008 | Maddan | C09C 1/0018 252/182.33 |
| 2009/0118562 | A1 * | 5/2009 | Cole | A61L 2/238 588/313 |

* cited by examiner

*Primary Examiner* — Sheng H Davis
(74) *Attorney, Agent, or Firm* — Ulysses John Biffoni

(57) ABSTRACT

The present invention relates to a process for decontaminating surfaces contaminated with one or more toxic agents. The processes include contacting a contaminated surface with a porous metal hydroxide which rapidly absorbs the toxic agent from the surface, then decontaminates the agent via reactions involving surface functional groups.

12 Claims, No Drawings

POROUS METAL HYDROXIDES FOR DECONTAMINATING TOXIC AGENTS

U.S. GOVERNMENT INTEREST

The invention described herein may be manufactured, used and licensed by or for the U.S. Government.

FIELD OF INVENTION

This invention relates to reactive sorbents and methods of making and using the same for decontaminating surfaces contaminated with highly toxic compounds, including but not limited to chemical warfare ("CW") agents and/or toxic industrial chemicals, insecticides and insecticide precursors, and the like.

BACKGROUND OF THE INVENTION

Exposure to toxic agents, such as CW agents and related toxins, is a potential hazard to the armed forces and to civilian populations, since CW agents are stockpiled by several nations, and other nations and groups actively seek to acquire these materials. Some commonly known CW agents are bis-(2-chloroethyl) sulfide (HD or mustard gas), pinacolyl methylphosphonothiolate (soman or GD), sarin (GB), cyclosarin (GF), and 0-ethyl S-(2-diisopropylamino) ethyl methylphosphonothiolate (VX), as well as analogs and derivatives of these agents. These CW agents are generally delivered as fine aerosol mists which, aside from presenting an inhalation threat, will deposit on surfaces of military equipment and hardware, including uniforms, weapons, vehicles, vans and shelters. Once such equipment and hardware is contaminated with one or more of such highly toxic agents, the agent must be removed in order to minimize contact hazards and to return the item to service.

For this reason, there is an acute need to develop and improve technology for decontaminating surfaces contaminated with highly toxic materials, such as CW agents. This is especially true for the class of toxic chemicals known as nerve agents, which are produced and stockpiled for both industrial use and as CW agents. One class of nerve agent with a high level of potential lethality is the class that includes organophosphorus-based ("OP") compounds, such as sarin, soman, and VX. Such agents can be absorbed through inhalation and/or through the skin of an animal or person. The organophosphorus-type ("OP") CW materials typically manifest their lethal effects against animals and people by inhibiting acetylcholine esterase ("AChE") enzyme at neuromuscular junctions between nerve endings and muscle tissue to produce an excessive buildup of the neurotransmitter acetylcholine, in an animal or person. This can result in paralysis and death in a short time.

In addition to the concerns about CW agents, there is also a growing need for decontaminating surfaces contaminated with toxic industrial chemicals that include, for example, insecticides and their corresponding intermediates and precursors. Examples of toxic industrial chemicals include AChE-inhibiting pesticides such as parathion, paraoxon, diazinon and malathion. Said compounds are manufactured on the industrial scale and, in the event of a leak or dispersal, can result in contamination of large areas that must be effectively decontaminated in order to control the spread of toxins as well as limit/minimize threat to personnel in said areas. Thus, it is very important to be able to effectively decontaminate surfaces with a broad spectrum of toxic chemicals, including, but not limited to, organophosphorus-type compounds.

Furthermore, CW agents and related toxins are so hazardous that simulants have been developed for purposes of screening decontamination and control methods. These simulants include 2-chloroethylphenyl sulfide (CEPS) and 2-chloroethylethyl sulfide (CEES), an HD simulant, dimethyl methyl phosphonate (DMMP), a G-agent simulant, and O-ethyl-S-ethyl phenylphosphonothioate (DPPT), a VX simulant.

Up until about the year 2000, the U.S. Army used a decontamination solution called DS2, which is composed (by weight) of 2% NaOH, 28% ethylene glycol monomethyl ether, and 70% diethylenetriamine (Richardson, G. A. "Development of a package decontamination system," EACR-1 310-17, U.S. Army Edgewood Arsenal Contract Report (1972)). This solution was used to decontaminate surfaces contaminated with CW agents. Although this decontamination solution is effective against CW agents, DS2 is quite toxic, flammable, highly corrosive, and releases toxic by-products into the environment. In addition, manufacture of DS2 exposes personnel to undue risks due to the toxic nature of the ingredients. For example, a component of DS2, namely diethylenetriamine, is a teratogen, so that the manufacture and use of DS2 also presents a potential health risk. DS2 protocol calls for waiting 30 minutes after DS2 application, then rinsing the treated area with water in order to complete the decontamination operation. The long mission time and need for water wash can present logistical implications, especially in battlefield environments.

The U.S. Army previously developed and employed a solid decontamination material called XE555 resin (Ambergard™ Rohm & Haas Company, Philadelphia, Pa.) to remove toxic agents from the contaminated surface. The resin powder was applied to the surface using a mitt. XE555 has several disadvantages, however. Although effective at removing chemical agents, XE555 does not possesses sufficient reactive properties to neutralize the toxic agent(s) picked-tip (absorbed) by this resin. Thus, after use for decontamination purposes, XE555 itself presents an ongoing threat from off-gassing toxins and/or vapors mixed with the resin. Further, XE555 resin presents a contact and inhalation hazard. XE555 is expensive to manufacture in the quantities required for decontamination purposes. As a result, XE555 resin was not suitable for large area decontamination operations.

Reactive sorbents have been developed and used to both absorb and react with highly toxic materials to yield less toxic products (U.S. Pat. No. 6,852,903). One example is M100 Sorbent Decontamination System (SDS) for decontaminating highly toxic materials. The M100 SDS utilizes an aluminum oxide-based reactive sorbent called A-200-SiC-1005S, which is in the form of a powder. A-200-SiC-1005S is made from a dehydroxylated silica-alumina powder blended with 5% carbon to achieve a grey color. The reactive sorbent powder acts as an inexpensive, non-corrosive, non-harmful absorber designed to be rubbed onto a contaminated surface. The decontamination powder does not require water rinse or special disposal. The reactive sorbent is structured to flow readily across a contaminated surface, and is highly porous allowing it to rapidly absorb the highly toxic material from the contaminated surface. The absorbed highly toxic material is strongly retained within the pores of the reactive sorbent, which reacts to form less toxic products thereby minimizing off-gassing and contact hazards.

Another example is found in U.S. Pat. No. 5,689,038, to Bartram and Wagner, disclosing the use of an aluminum oxide, or a mixture of aluminum oxide and magnesium monoperoxyphthalate (MMPP), as reactive sorbents to decontaminate surfaces contacted with droplets of chemical warfare agents. It has been reported that both materials were able to effectively remove such toxic agents from a surface to the same extent as XE555. In addition, both materials represented improvements in chemical warfare agent degrading reactivity and in reducing off-gassing of toxins relative to XE555. The reported sorbents were based on pre-existing, commercially available materials, such as Selexsorb CD™, a product of the Alcoa Company. Essentially, Bartram and Wagner reported that their aluminum oxide is modified by size reduction, grinding or milling.

Another example is U.S. Pat. No. 6,537,382 to Bartram and Wagner, disclosing the use of two types of reactive sorbents. One comprises metal exchanged zeolites such as silver-exchanged zeolite, and the other comprises sodium zeolites. The reactive sorbents remove, and then decompose chemical agents from the surface being decontaminated. Similar in all reactive sorbents, this dual action provides the advantage of reducing the risks associated with potential offgassing from the sorbent, and reducing the toxicity of the sorbent for disposal purposes.

In still another example, U.S. Pat. No. 8,530,719 to Peterson et al. disclose the use of zirconium hydroxide as a base for a solid phase decontamination media. The authors report the ability of zirconium hydroxide, and zirconium hydroxide loaded with zinc, triethylenediamine, or zinc plus triethylenediamine to detoxify chemical agents VX and GD. No data regarding the ability of these media to decontaminate a surface contaminated with toxic chemicals is reported.

Detoxification of surfaces in a field setting is essential to improving user safety as well as reducing the time necessary for contaminated equipment to return to service. As such new agents and methods of detoxification are needed.

SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

Provided are methods for decontaminating surfaces contaminated with one or more toxic agents using a porous metal hydroxide. Porous metal hydroxides are defined as any metal hydroxide, or mixtures thereof, that is relatively insoluble in water and possesses sufficient porosity to absorb toxic chemical present on a contaminated surface. Porous metal hydroxide materials also offer detoxification capabilities due to reactions involving the hydroxyl groups thereby degrading toxic agents at the site of contamination thereby improving user safety and reducing return to service time.

Examples of porous metal hydroxides used in the process described herein include, but are not limited to, hydroxides of silicon, aluminum, magnesium, cobalt, copper, zinc, titanium, zirconium, vanadium, chromium, manganese, nickel and calcium, and mixtures thereof. Mixtures may include physical mixtures of porous metal hydroxides, such as for example a physical mixture of silicon hydroxide particles and aluminum hydroxide panicles. Alternatively, mixtures may include porous co-metal hydroxides, such as for example silicon-aluminum hydroxide, iron-silicon hydroxide, etc. Porous metal hydroxides may be readily prepared via precipitation reactions involving the contacting of metal solutions with a precipitating agent sufficient to yield the corresponding porous metal hydroxide.

A process of decontaminating a surface contaminated with at least one toxic agent includes contacting a surface contaminated with at least one toxic agent with a porous metal hydroxide. In some aspects, a porous metal hydroxide excludes pure zirconium hydroxide. In some aspects, a porous metal hydroxide includes a hydroxide of silicon, aluminum, magnesium, cobalt, copper, zinc, titanium, zirconium, vanadium, chromium, manganese, nickel, calcium, or mixtures thereof. Optionally, a porous metal hydroxide is aluminum hydroxide, iron hydroxide, zinc hydroxide, silicon hydroxide, magnesium hydroxide, cobalt hydroxide, copper hydroxide, titanium hydroxide, vanadium hydroxide, chromium hydroxide, manganese hydroxide, nickel hydroxide, calcium hydroxide, iron-silicon hydroxide, iron-aluminum hydroxide, and silicon-aluminum hydroxide.

A porous metal hydroxide used in the processes optionally includes a surface area of 5 $m^2/g$ or greater, optionally 200 $m^2/g$ or greater. In some aspects, a porous metal hydroxide includes a pore volume 0.1 $cm^3/g$ or greater, optionally 0.5 $cm^3/g$ or greater. In any aspect a porous metal hydroxide is optionally in the form of a particle, the particle optionally including a linear cross sectional dimension of less than 100 micrometers.

A process optionally further includes rinsing the surface with water, an organic solvent, or combinations thereof.

Porous metal hydroxides have been found to be surprisingly effective in the rapid decontamination of contaminated surfaces, while also offering detoxification capabilities which in many cases exceeds that of the current sorbent A-200-SiC-1005S.

DETAILED DESCRIPTION OF THE INVENTION

The present invention relates to a porous metal hydroxide capable of removing toxic compounds from contaminated surfaces and decomposing the absorbed compounds. Chemical warfare agents can be used on the battlefield to inflict casualties on opposing forces, to reduce the effectiveness of opposing forces, or to cover a retreat, for example. During a chemical attack, chemical warfare agents such as for example HD, GD or VX, are delivered as a fine aerosol mist over a target area. The agent droplets deposit on the surface of military equipment, such as for example weapon systems, transportation vehicles, aircraft, shelters, tents, and personal equipment. The surfaces associated with these items are highly contaminated and the resulting contaminated item is no longer usable due to the associated hazard. The first step in putting the item back into service is to remove the bulk of the chemical agent from the item. This process is referred to as immediate decontamination and is performed at the first available opportunity following the chemical attack. Once immediate decontamination operations are complete, contaminated items and material can be transported to decontamination facilities with minimal threat of chemical agent transfer (for example, from a highly contaminated item to another item or personnel). While immediate decontamination removes the bulk of the chemical agent, thorough decontamination reduces the chemical agent levels associated with an item to no-effect levels, thereby allowing the item to be brought back into service. Immediate decontamination also reduces time and resources required to complete thorough decontamination, plus minimizes the spread of CW agents that may result from contact.

It should be noted that the present invention is not limited to chemical warfare, but also may be applied to the clean-up of toxic chemical spills, such as for example mineral acids, pesticides and pesticide precursors.

Immediate decontamination can be performed by contacting a contaminated surface with a sorbent such as for example a porous metal hydroxide. A porous metal hydroxide as defined herein is a metal hydroxide, mixed metal hydroxide, or mixtures thereof optionally having surface area(s) of or greater than 5 $m^2/g$, optionally of or greater than 10 $m^2/g$, optionally of or greater than 20 $m^2/g$, optionally of or greater than 30 $m^2/g$, optionally of or greater than 40 $m^2/g$, optionally of or greater than 50 $m^2/g$, optionally of or greater than 200 $m^2/g$, optionally of or greater than 500 $m^2/g$. In some aspects the pore volume of a porous metal hydroxide is at or greater than 0.1 $cm^3/g$, optionally at or greater than 0.25 $cm^3/g$, optionally at or greater than 0.5 $cm^3/g$.

A porous metal hydroxide optionally includes a metal with a +1, +2, +3, +4, or +5 oxidation state. Illustrative non-limiting examples of porous metal hydroxides include aluminum hydroxide, iron hydroxide, zinc hydroxide, silicon hydroxide, magnesium hydroxide, cobalt hydroxide, copper hydroxide, titanium hydroxide, vanadium hydroxide, chromium hydroxide, manganese hydroxide, nickel hydroxide, calcium hydroxide, and the like. In some aspects a metal hydroxide is not pure zirconium hydroxide where pure zirconium hydroxide is zirconium hydroxide that is not in a mixed metal hydroxide form. In some aspects, a metal hydroxide excludes pure zirconium hydroxide and zirconium hydroxide in a mixed metal hydroxide.

A porous metal hydroxide is optionally a mixed metal hydroxide. Illustrative examples of mixed metal hydroxides include but are not limited to metal hydroxides including two or more metals of aluminum, iron, zinc, silicon, magnesium, cobalt, copper, titanium, vanadium, chromium, manganese, nickel, calcium, zirconium, and the like. Specific illustrative examples of mixed metal hydroxides include iron-silicon hydroxide, iron-aluminum hydroxide, silicon-aluminum hydroxide, among others. The porosity associated with the porous metal hydroxide allows for absorption of the toxic chemical from the surface of a contaminated item into the pores of the reactive sorbent, where the toxic chemical will be decomposed.

Accordingly, the invention provides novel methods for removing and deactivating a wide range of highly toxic materials, including CW agents. In order to appreciate the scope of the invention, the terms "toxin," "toxic agent" and "toxic material" are intended to be equivalent, unless expressly stated to the contrary. In addition, the terms "nerve gas," "nerve agent," and "neurotoxin," and the like are intended to be equivalent, and to refer to a toxin that acts or manifests toxicity, at least in part, by disabling a component of an animal nervous system, e.g., AchE inhibitors.

In addition, the use of a term in the singular is intended to encompass its plural in the appropriate context, unless otherwise stated. A toxic agent encompasses CW agents, including, e.g., toxic organophosphorus-type agents, mustard gas and derivatives, and similar such art-known toxins. Illustrative specific examples of CW agents, include but are not limited to bis-(2-chloroethyl)sulfide (HD or mustard gas), pinacolyl methylphosphonofluoridate (GD), Tabun (GA), Sarin (GB), cyclosarin (GF), and O-ethyl S-(2-diisopropylamino)ethyl methylphosphonothioate (VX), other toxic organophosphorus-type agents, their analogs or derivatives, and similar such art-known toxins. In addition, unless otherwise stated, the term "toxic agent" as used herein is also intended to include toxic industrial chemicals, including, but not limited to, organophosphorus-type insecticides, and the like. Mineral acids, such as for example hydrochloric acid solutions, sulfuric acid solutions, etc. are also exemplary toxic agents.

Broadly, the novel process provided by the invention is directed to the use of porous metal hydroxides effective for removing, and then deactivating or neutralizing, toxic agents. The porous metal hydroxide optionally includes any metal hydroxide or multi-metal hydroxide, or mixture thereof that is capable of absorbing, or taking up harmful toxic materials including toxic agents, and then catalytically or stoichiometrically reacting, converting, deactivating, neutralizing, or detoxifying at least a portion of the absorbed toxic agent. The term "surface" applies to hard surfaces such as counter tops, concrete, metals, plastic, tiles, and so forth, soft surfaces such as fabric, film, leather, carpet or upholstery, or that of human or animal skin surfaces.

Properties of Exemplary Porous Metal Hydroxides:

As chemical agent and other toxic chemicals, once released, will be present on surfaces in the form of a liquid, such as for example, pools, droplets, etc., it is desired that the porous metal hydroxide have sufficient porosity so that it readily and rapidly absorbs the toxic compound. The liquid toxic chemical will be absorbed into the pore structure of the porous metal hydroxide. Thus, the porous metal hydroxide must have sufficient pore volume to accommodate the liquid toxic chemical when using a reasonable amount of material to decontaminate the surface. In some aspects, the surface area is at or greater than about 50 $m^2/g$, optionally at or greater than 200 $m^2/g$, optionally at or greater than 500 $m^2/g$. In some aspects, the pore volume of the porous metal hydroxide is at or greater than 0.1 $cm^3/g$, optionally at or greater than 0.25 $cm^3/g$, optionally at or greater than 0.5 $cm^3/g$. While a high surface area promotes a high concentration of reactive sites, a high pore volume is necessary to promote rapid absorption of the toxic chemical.

In some aspects, the porous metal hydroxide has the capability to detoxify toxic compounds once absorbed into the pore structure. Should the porous metal hydroxide be required to decontaminate surfaces contaminated with chemical warfare agents, the hydroxyl groups associated with the porous metal hydroxide are capable of facilitating substitution and elimination reactions necessary to detoxify highly toxic chemical warfare agents. For example, mustard (HD) will undergo elimination reactions upon contact with hydroxyl groups to yield the vinyl product plus HCl. Should the porous metal hydroxide be used to clean up an acid spill, the porous metal hydroxide will be able to neutralize said acid. For example, a metal hydroxide will react with and neutralize sulfuric acid to yield the corresponding metal sulfate plus water.

In some aspects, the porous metal hydroxide has a very low solubility in water, such as for example solubility less than 0.1 g per 100 ml of water. This is because moisture may also be present on contaminated surfaces. Should moisture be excessive, a water soluble porous metal hydroxide will begin to dissolve, forming a thick paste-like substance on the surface. Said substance will be difficult to spread, greatly increasing the mission time. Further, highly water soluble metal hydroxides, such as sodium hydroxide and potassium hydroxide, are highly corrosive.

The porous metal hydroxide employed by the process described herein may be of several geometric forms. Said forms include beads, spheres, granules, powders, etc. and may be prepared using techniques known to one skilled in the art. Small beads or bead-like geometries, such as that prepared by spray drying processes as known in the art, for example, are preferred in some aspects. This is because beads and bead-like geometries will readily flow across the surface, optimizing the time required to perform the process. Particles having a linear cross sectional dimension on the order of about 5 nm to 100 μm may be used, optionally 50 nm to 100 μm, optionally 100 nm to 100 μm, optionally 500 nm to 100 μm, optionally 5 nm to 99 μm, optionally 5 μm to 100 μm, 5 μm to 99 μm, optionally 5 μm to about 80 μm.

Sorbent Preparation

Porous metal hydroxides can be prepared via precipitation routes as known by one skilled in the art. Porous metal hydroxides may be precipitated by contacting a soluble form of the metal with an acidic or alkaline solution in a manner which alters the pH of the solution such as to bring about precipitation. For example, aluminum hydroxide may be prepared by contacting an aluminum solution, such as for example one prepared using sodium aluminate dissolved in sodium hydroxide, with an acidic solution, such as for example sulfuric acid at a pH sufficient to bring about precipitation. While not wishing to be bound by any theory, one possible reaction pathway by which precipitation leading to the formation of aluminum hydroxide occurs is as follows:

$$NaAlO_2 + NaOH \xrightarrow{H2SO4} Na_2SO_4 + Al(OH)_3$$

Aluminum hydroxide can also be prepared using aluminum nitrate according to:

$$Al(NO_3)_3+3NaOH \rightarrow 3NaNO_3+Al(OH)_3$$

Other porous metal hydroxides, such as those involving magnesium, aluminum, silicon, calcium, titanium, iron, cobalt, nickel, copper, zinc and zirconium, or co-precipitated solids thereof, or mixtures thereof, can be prepared via similar techniques. Soluble forms of magnesium include magnesium chloride, magnesium sulfate and magnesium nitrate, for example. Soluble forms of aluminum include sodium aluminate and aluminum nitrate, for example. Soluble forms of silicon include sodium silicate and colloidal silica solutions, for example. Fumed silicas can also be digested or partially digested in sodium hydroxide solutions. Soluble forms of calcium, iron, cobalt, nickel, copper and zinc include the corresponding nitrates, sulfates and chlorides, for example. Soluble forms of titanium include titanium sulfate. Soluble forms of zirconium include zirconium oxynitrate and zirconium oxychloride, for example.

If the soluble form of the metal results in an acidic solution, alkali metal hydroxides, such as lithium hydroxide, sodium hydroxide and potassium hydroxide can be used to increase the pH of the solution, thereby bringing about the formation of the porous metal hydroxide via precipitation. Other bases, such as ammonium hydroxide, can also be used. If the soluble form of the metal results in a basic solution, mineral acids, such as sulfuric acid, hydrochloric acid and nitric acid, may be used to decrease the pH of the solution, thereby bringing about the formation of the porous metal hydroxide. Other acids, such as organic acids of which formic acid is included, may also be used.

Mixed or co-precipitated porous metal hydroxides may also be prepared. For example, a co-precipitated iron-silicon hydroxide may be prepared by combining an alkaline sodium silicate solution with an acidic iron chloride solution to bring about the formation of a porous iron-silica hydroxide. Said solutions can also contain excess alkali or acids so that the relative amounts of each metal in the porous metal hydroxide may be allowed to vary.

When forming the porous metal hydroxide, structure directing agents may be added to the precipitation solution to enhance the porosity. Examples of structure directing agents include, but are not limited to glycols, ethers, quaternary ammonium salts, and the like. Examples of glycols include polyethylene glycol and polypropylene glycol. Examples of ethers include dimethyl ether and diethyl ether. Examples of quaternary ammonium salts include tetrapropylammonium bromide and tetrabutulammonium bromide. The use of structure directing agents can greatly affect the porosity of the resulting porous metal hydroxide.

Once precipitation is complete, the porous metal hydroxide is optionally washed with water to remove any dissolved salts or structure directing agent from the pore structure, then dried. Drying is a key step in the operation, as at too high of temperature, the porous metal hydroxide will begin to decompose to the corresponding oxide. Decomposition will decrease the porosity of the resulting solid plus remove hydroxyl groups necessary to facilitate reactions related to detoxification. Ideally, the porous metal hydroxide is dried at temperatures below about 150° C., although higher temperatures and short durations may be employed. The upper temperature limit employed in the drying operation will depend upon the composition of the porous metal hydroxide.

Such processes optionally produce a porous metal hydroxide that is substantially pure. The term substantially pure is meant free of additional contaminating metals, salts, acids, or other materials that may detract from the effectiveness of the resulting porous metal hydroxide. Substantially pure optionally means 90% pure, optionally 91% pure, optionally 92% pure, optionally 93% pure, optionally 94% pure, optionally 95% pure, optionally 96% pure, optionally 97% pure, optionally 98% pure, optionally 99% pure, optionally 99.1% pure, optionally 99.2% pure, optionally 99.3% pure, optionally 99.4% pure, optionally 99.5% pure, optionally 99.6% pure, optionally 99.7% pure, optionally 99.8% pure, optionally 99.9% pure, or of greater purity.

A porous metal hydroxide optionally includes or is free of additional reactive moieties. A porous metal hydroxide optionally includes or is free of a reactive moiety either adsorbed to the surface of the porous metal hydroxide, impregnated into the porous metal hydroxide, or co-precipitated with the porous metal hydroxide. Illustratively, a porous metal hydroxide optionally includes or is free of one or more reactive, catalytic, or functional groups (in sum "reactive moiety"). Illustrative examples of reactive, catalytic, or functional groups include base metals or amines. A base metal is optionally vanadium, chromium, manganese, iron, cobalt, nickel, copper, zinc, silver, molybdenum, and mixtures thereof. When present, a base metal is optionally in the amount of about 5% to about 40% by weight of the sorbent, optionally at or about 15% to about 25%.

A reactive, catalytic, or functional group is optionally an amine. Illustrative examples of an amine include triethylamine (TEA), quinuclidine (QUIN), triethylenediamine (TEDA), pyridine, and pyridine carboxylic acids such as pyridine-4-carboxylic acid (P4CA). The loading of an amine, illustratively TEDA, is optionally as low as 0 wt. %, or as high as about 6 wt. %. Optionally an amount of amine, illustratively TEDA, used is of from about 3% to about 6% by weight of the sorbent Illustrative examples of methods for the incorporation of reactive, catalytic, or functional group(s) into a hydroxide are found in U.S. Pat. No. 8,530,719.

A porous metal hydroxide is optionally free of a base metal or an amine. A porous metal hydroxide is optionally provided and used in processes of decontamination as dry powder, optionally free of an organic solvent. The porous metal hydroxides are effective as decontamination agents in the absence of organic solvent. However, in some aspects, a porous metal hydroxide is provided with one or more organic solvents either partially or entirely occupying the pores. An organic solvent is optionally in liquid or solid phase.

An organic solvent is optionally any organic solvent capable of dissolving any or all highly toxic materials, including chemical warfare agents and remaining non-reactive with the porous metal hydroxide while exhibiting sufficiently low volatility to remain on the sorbent during the decontamination phase. Optionally, the organic solvent is an alkane having a chemical formula $C_nH_{2n+2}$, wherein n is at least 9, optionally at least 20. Optionally, the organic solvent is mineral oil, paraffin wax, or combinations thereof.

When present, an organic solvent is present in an amount to sufficiently saturate the pores of the porous metal hydroxide, while maintaining the sorbent in a dry, free-flowing powder form. An organic solvent optionally is present in ranges from about 5% to 50% by weight, optionally 15% to 35% by weight, optionally 20% to 30% by weight based on the total weight of the modified porous metal hydroxide. Alternatively, the amount of the organic solvent is present in a porous metal hydroxide to solvent weight proportion of about 10 parts metal hydroxide to a range of from about 1 to 5 parts solvent, optionally from about 2 to 3 parts solvent. Further information regarding sorbents impregnated by organic solvents can be found in U.S. Pat. No. 7,678,736. Illustrative examples of methods for the incorporation of solvent(s) into a hydroxide are found in U.S. Pat. No. 8,530,719.

Testing Methods

Exemplary chemical agent simulants employed in the testing include 2-chloroethyl phenyl sulfide (CEPS) and O-ethyl-S-ethyl phenylphosphonothioate (DPPT). CEPS is a simulant for sulfur mustard (HD), while DPPT is a simulant for chemical agent VX. Both CEHPS and DPPT are known by one skilled in the art to possess reactive and absorptive properties similar to the corresponding chemical agent.

The ability of porous metal hydroxides to destroy chemical agent simulants may be assessed as follows. 150 mg of porous metal hydroxide is added to a 12 $cm^3$ vial. To the porous metal hydroxide is added either 15 mg or 75 mg of chemical agent simulant. The vial is then capped and placed in a circulating water bath at 25° C. for two hours. Following 2 hours, the vial and contents are removed from the water bath and the reaction is quenched by adding 10 ml solvent to extract any unreacted chemical agent simulant from the pores of the material. Illustrative examples of a solvent include n-hexane for CEPS and isopropyl alcohol for DPPT. The vial may then be placed on a wrist shaker where it is agitated for 10 minutes. Following agitation, the extraction solvent is analyzed for residual chemical agent simulant using gas chromatographic techniques. The conversion of chemical agent simulant is determined by subtracting from unity the mass of chemical agent simulant extracted from the porous metal hydroxide divided by the mass of chemical agent simulant initially added to the porous metal hydroxide.

The ability of the porous metal hydroxide to remove chemical agent simulant from a contaminated surface may be determined by adding 35 mg of chemical agent simulant as 3-5 μl droplets to a stainless steel surface approximately 35 $cm^2$ in area. Either 75 or 150 mg of porous metal hydroxide powder is then added to the contaminated surface. The porous metal hydroxide is rubbed across the surface using a stainless steel applicator until all visible droplets of simulant are absorbed by the porous metal hydroxide. The stainless steel surface is then placed in a jar containing 25 ml of solvent and agitated. Illustrative examples of a solvent include n-hexane for CEPS and isopropyl alcohol for DPPT. The solvent is then evaluated for residual chemical agent simulant. The percent of surface decontamination may be determined by subtracting from unity the mass of chemical agent simulant contained in the extraction solvent by the mass of chemical agent added to the surface. Surface area and pore volume data may be recorded using $N_2$ adsorption at liquid nitrogen temperatures.

The step of contacting a surface contaminated with at least one toxic agent with a porous metal hydroxide is optionally by placing the metal hydroxide in direct contact with a contaminated surface, with the toxic agent itself, or both. The step of contacting may be performed over a wide range of temperatures and humidity values consistent with ambient conditions. For example, the contacting step can be carried out at a temperature from −40° C. to 200° C., optionally −40° C. to 45° C. The relative humidity can be as low as less than 10% to greater than 90%.

In some aspects, a porous metal hydroxide is contacted to a contaminated surface(s) for at least 0.5 minutes, optionally from 1-100 minutes, optionally from 1.5-20 minutes. The porous metal hydroxide is optionally contacted to the surface until such time as either substantially all the toxic agent is destroyed by the porous metal hydroxide, or until the porous metal hydroxide is chemically exhausted. The time required for achieving a satisfactory detoxification or neutralization of one or more toxic agents is in the range of less than 30 seconds to 3 hours.

A porous metal hydroxide may be contacted to a surface by any suitable method known in the art, optionally by spraying, rubbing, brushing, dipping, dusting, pouring, or otherwise contacting the surface or composition that is believed to be in need of such treatment. Upon contact, the toxic agents are detoxified within the pores of the metal hydroxide, optionally by absorption, chemical modification, or combinations thereof.

In some aspects, the porous metal hydroxide is contacted to a contaminated surface or to a toxic chemical with the porous metal hydroxide as a dry powder or as a suspension in a carrier. Suitable carriers include polar and nonpolar solvents, illustratively water-based or organic solvent based carriers. Optionally, the carrier is prepared with sufficient viscosity to allow the composition to remain in contact with treated articles or surfaces for a sufficient time period to remove or detoxify contaminants. The selection of the physical form in which the porous metal hydroxide is dispersed depends upon the physical form of the contaminant(s), the nature of the terrain and/or equipment or personal needing decontamination, and the practical needs of distribution and removal of the used or spent porous metal hydroxide.

The porous metal hydroxide is optionally poured onto a contaminated surface. Optionally, the porous metal hydroxide powder is rubbed across the surface with a manual or mechanical action resulting in adequate contact between droplets of at least one toxic agent (located on the surface) and the porous metal hydroxide. "Adequate contact" is defined herein as at least 80% surface to surface contact between two objects with a minimal obstruction. Methods for facilitating contacting between at least one toxic agent (located on the surface) and the porous metal hydroxide may simply include rubbing with a wash mitt, brush, cloth, or other applicator.

In some aspects, a porous metal hydroxide in granulated form is optionally formulated so as to remain cohesive while absorbing a liquid suspected of containing one or more toxic agents. Advantageously, the used porous metal hydroxide in granulate form is readily scooped, brushed, or shoveled off the treated surface for further processing or disposal.

Various aspects of the present invention are illustrated by the following non-limiting examples. The examples are for illustrative purposes and are not a limitation on any practice of the present invention. It will be understood that variations and modifications can be made without departing from the spirit and scope of the invention.

EXAMPLES

Example 1: Preparation or Silicon Hydroxide 250 g of a sodium silicate solution (28% as silicon dioxide) was added to a 4 liter pail. To the solution was added 1.5 liters DI water. The solution was mixed for 15 minutes, then titrated to a pH of 7 using a 50% $H_2SO_4$ solution in order to bring about precipitation. The resulting slurry was mixed for 4 hours, then filtered. The product was washed twice with 3 liters of DI water, filtered, then dried at 90° C. overnight. Product was ground to less than 40 mesh particles, a portion of which were dried at 90° C. to a moisture content of less than 3% water. The sample was placed in a glass jar and sealed. The surface area of the sample was 295 $m^2/g$. The pore volume of the sample was 0.804 $cm^3/g$. Particle size was less than 40 mesh.

Example 2: Preparation of Silicon Hydroxide using Polyethylene Glycol

This example illustrates the effects of a structure directing agent on the porosity of precipitated metal hydroxides. 250 g of a sodium silicate solution (28% as silicon dioxide) was added to a 4 liter pail along with 25 g of polyethylene glycol (PEG–average molecular weight=1,450). To the solution was added 1.5 liters DI water and the solution was mixed until the PEG completely dissolved. Once dissolved, the solution was titrated to a pH of 7 using a 50% $H_2SO_4$ solution in order to bring about precipitation. The resulting slurry was mixed for 4 hours, then filtered. The product was washed twice with 3 liters of DI water, filtered, then dried at 90° C overnight. Product was ground to less than 40 mesh particles, a portion of which were dried at 90° C. to a moisture content of less than 3% water. The sample was placed in a glass jar and sealed. The surface area of the sample was 421 $m^2/g$. The pore volume of the sample was 0.682 $cm^3/g$. Particle size was less than 40 mesh.

Example 3: Preparation of Aluminum Hydroxide 250 g of a sodium aluminate solution (25% as aluminum oxide) was added to a 4 liter pail along with 25 g of polyethylene glycol (PEG–average molecular weight=1, 450). To the solution was added 1.5 liters DI water and the solution was mixed until the PEG completely dissolved. Once dissolved, the solution was titrated to a pH of 7 using a 50% $H_2SO_4$ solution in order to bring about precipitation. The resulting slurry was mixed for 4 hours, then filtered. The product was washed twice with 3 liters of DI water, filtered, then dried at 90° C. overnight. Product was ground to less than 40 mesh particles, a portion of which were dried at 90° C. to a moisture content of less than 3% water. The sample was placed in a glass jar and sealed. The surface area of the sample was 130 $m^2/g$. The pore volume of the sample was 0.13 $cm^3/g$. Particle size was less than 40 mesh.

Example 4: Preparation or Silicon-Aluminum Hydroxide 2.0 kg of sodium aluminate solution (25% $Al_2O_3$) was added to a 4 liter pail. To the solution was added 0.5 liters of DI water. To the solution was added 200 g of a sodium silicate solution (28% $SiO_2$) plus 100 g of a 50% NaOH solution. The pH of the slurry was then reduced to 7 using a 50% $H_2SO_4$ solution. The resulting gel was mixed for 3 hours, then filtered and washed twice with DI water. The solid precipitate was dried at 80° C. overnight. The material is 91.0% Al and 9.0% Si by weight. The surface area of the sample was 195 $m^2/g$. The pore volume of the sample was 0.25 $cm^3/g$. Particle size was less than 40 mesh.

Example 5: Preparation of Silicon-Aluminum Hydroxide

This batch was prepared using aluminum nitrate as both the aluminum source and precipitating agent. The material was prepared by adding 250 g of sodium silicate solution plus 1.5 liters DI water to a 4 liter pail. To the contents were added 25 g of tetrapropyl ammonium bromide as the structure directing agent plus 50 g of a 50% NaOH solution. A 60% aluminum nitrate solution was added to the slurry using a peristaltic pump. The $Al(NO_3)_3$ solution is 7.62% Al by weight. 216 g of solution were used to decrease the pH of the slurry to 8. The mixing was terminated following 4 hours and the slurry was allowed to stand overnight. The slurry was then filtered, then washed with DI water 3 times. The filtered product was then dried at 80° C. overnight. The material is 33.7% Al and 66.3% Si by weight. The surface area of the sample was 320 $m^2/g$. The pore volume of the sample was 0.59 $cm^3/g$. Particle size was less than 40 mesh.

Example 6: Preparation of Iron-Silicon Hydroxide 250 g of sodium silicate solution (28% $SiO_2$) was added to a 4 liter pail. To the solution was added 1 liter of DI water and 25 g of polyethylene glycol (average Molecular weight=1,450). The solution was mixed for 1 hour. An iron sulfate solution was prepared by dissolving 300 g $FeSO_4.6H_2O$ in DI water (total volume=800 ml). 266 g of the iron sulfate solution was added to the slurry using a peristaltic pump in order to decrease the pH of the slurry to 7. Following 4 hours, mixing was terminated and the slurry was allowed to stand overnight. In the morning, the slurry was filtered, then washed twice with 3 liters of DI water. The final product was dried at 80° C. overnight. The composition was 33.1% Fe and 66.9% Si by weight. The surface area of the sample was 570 $m^2/g$. The pore volume of the sample was 0.47 $cm^3/g$. Particle size was less than 40 mesh.

Example 7: Preparation of Iron-Silicon Hydroxide

A precipitated iron/silica was prepared by dissolving 200 g of iron sulfate (20% iron) in 1 liter of DI water. To the solution was added 20 g of Polycat-41 as a structure directing agent. A second solution was prepared by diluting 825 g of $Na_2SiO_3$ solution (28% $SiO_2$) with 600 g of DI water. The sodium silicate solution as added the iron solution using a peristaltic pump. The entire amount of sodium silicate solution reduced the pH of the slurry to 7.65. The resulting slurry was blended for 4 hours, aged overnight, then filtered. The solids were washed 3 times with DI water, filtered, then dried at 80° C. The composition was 27.1% Fe and 72.9% Si by weight. The surface area of the sample was 320 $m^2/g$. The pore volume of the sample was 0.74 $cm^3/g$. Particle size was less than 40 mesh.

Example 8: Precipitated Iron Hydroxide

A precipitated iron hydroxide was prepared by dissolving 120 g NaOH in 1 liter DI water along with 20 g of Polycat-41 as a structure directing agent. 267 of iron chloride was dissolved in DI water to a final weight solution weight of 807 g. The entire solution was added over a 30 minute period using a peristaltic pump to the caustic solution and achieved a pH of 8.0. The resulting slurry was mixed for 4 hours, then allowed to stand overnight. In the morning, the gel was re-mixed, filtered, then washed 3 times with DI water. The filtered product was dried overnight at 80° C. The surface area of the sample was 180 $m^2/g$. The pore volume of the sample was 0.15 $cm^3/g$. Particle size was less than 40 mesh.

Example 9: Precipitated Iron-Aluminum Hydroxide

An iron-aluminum hydroxide was prepared by dissolving 100 g of sodium hydroxide and 100 g of sodium aluminate in 1.5 L of DI water at 90° C. Once dissolved, 30 g of tetrapropylammonium bromide was added as a structure directing agent, and the solution was allowed to cool to room temperature under agitation. A second solution was prepared by dissolving 200 g of iron chloride in 500 g of DI water plus 50 grams of sulfuric acid. With both solutions at room temperature, the iron chloride solution was added to the sodium aluminate solution to a pH of 8. This required 640 g of the iron chloride solution. The resulting gel was mixed for three hours, then allowed to stand overnight. In the morning, the material was remixed for 5 minutes, and then filtered. The material was then washed three times with DI water, with the filtered solids dried overnight at 80° C. The resulting material was 44% aluminum and 56% iron by weight. The surface area of the sample was 355 $m^2/g$. The pore volume of the sample was 0.35 $cm^3/g$. Particle size was less than 40 mesh.

Example 10: Precipitated Iron-Silicon-Aluminum Hydroxide

A precipitated iron-silicon-aluminum hydroxide was prepared as follows. 80 g of sodium hydroxide, 20 g of sodium silicate solution (20% $SiO_2$), and 80 grams of sodium aluminate were added to 1.5 L of DI water. The slurry was heated to 65° C. in order to dissolve the sodium aluminate. Once dissolved, the solution was mixed and allowed to cool to room temperature. At this time, 30 g of tetrapropylammonium bromide was added to the solution. A second solution was prepared by dissolving 300 g of iron chloride in 800 grams of DI water. The iron chloride solution was added to the sodium aluminate-sodium silicate solution until a pH of 8 was achieved. This required 738 g of solution. The resulting slurry was mixed for 3.5 hours then allowed to stand overnight. In the morning, the slurry was remixed for 5 minutes, and then filtered. The material was then washed three times in DI water, then dried overnight at 80° C. The resulting material was 33% Al/4% Si/63% Fe by weight. The surface area of the sample was 303 $m^2/g$. The pore volume of the sample was 0.41 $cm^3/g$. Particle size was less than 40 mesh.

Example 11: Precipitated Magnesium-Iron-Silicon Hydroxide

A magnesium-iron-silicon hydroxide was prepared by adding 80 grams of sodium hydroxide and 100 grams of sodium silicate solution (28% $SiO_2$) to 1 L of DI water. Once blended, 30 grams of tetrapropylammonium bromide was added. A second solution was prepared by dissolving 200 grams of iron chloride and 100 grams of magnesium chloride in 550 grams of DI water. The iron-magnesium solution was added to the sodium aluminate solution to a pH of 8. This required 614 g of solution. The precipitated material was blended for 3.5 hours, then allowed to stand overnight. In the morning, the material was remixed for 5 minutes, and then filtered. The material was then washed three times in DI water, with the resulting solids dried overnight at 80° C. The resulting material was 16% Mgl/27% Si/57% Fe by weight. The surface area of the sample was 446 $m^2/g$. The pore volume of the sample was 0.38 $cm^3/g$. Particle size was less than 40 mesh.

Example 12: Precipitated Cobalt Hydroxide

A precipitated cobalt hydroxide was also prepared by dissolving 100 g of sodium hydroxide in 1.5 L of DI water. Once dissolved, 30 grams of tetrapropylammonium bromide was added as a structure directing agent. A second solution was prepared by dissolving 200 grams of cobalt nitrate in 500 g of DI water. The pH of the slurry was at 13 following the addition of the cobalt nitrate solution. 32 g of sulfuric acid was added to reduce the pH of the slurry to 8.0. The slurry was mixed for 3.5 hours during which the solution was maintained at pH 8 using sulfuric acid. The material was allowed to age overnight at room temperature. In the morning, the precipitated cobalt hydroxide was mixed for 5 minutes, and then filtered. The resulting solids were washed three times in DI water. Following the last washing, the solids were filtered and dried overnight at 80° C. The surface area of the sample was 43 $m^2/g$. The pore volume of the sample was 0.15 $cm^3/g$. Particle size was less than 40 mesh.

Example 13: Preparation of Cobalt-Zirconium Hydroxide

A precipitated cobalt-zirconium hydroxide was prepared by adding 1.5 liter of DI water to a 4 liter pail, along with 50 g of tetrapropyl ammonium bromide as a structure directing agent. The pH of the slurry was adjusted to 11 using KOH. A zirconium cobalt solution was prepared by dissolving 143.3 g of cobalt chloride (34.9 wt % $Co_2O_3$) in 750 ml of zirconium oxychloride (20% $ZrO_2$). The cobalt zirconia solution was added using a peristaltic pump over a 30 minute period with the pH maintained at 11 using a 50% KOH solution as a buffer. Upon completion, the pH of the slurry was monitored and reduced back to 11 using $H_2SO_4$. Following 4 hours of mixing, the slurry was allowed to stand overnight. In the morning, the slurry was washed twice with 3 liters of DI water, then filtered and dried at 80° C. The surface area of the sample was 260 $m^2/g$. The pore volume of the sample was 0.26 $cm^3/g$. Particle size was less than 40 mesh.

Example 14: Preparation of Copper Hydroxide

Copper hydroxide was prepared by dissolving 100 g copper chloride (37.5% Cu) in 250 ml DI water. To the copper chloride solution was added 10 g of tetrapropylammonium bromide as a structure directing agent. A sodium hydroxide solution was prepared by dissolving 60 g NaOH in 150 ml DI wafer. The NaOH solution was added to the copper chloride solution to a pH of 8. The slurry was mixed for an additional 4 hours, then allowed to stand overnight. In the morning, the resulting copper hydroxide was filtered from the solution, then washed three times using DI water. Following washing, the material was dried at 80° C. overnight. The surface area of the sample was 130 $m^2/g$. The pore volume of the sample was 0.37 $cm^3/g$. Particle size was less than 40 mesh.

Example 15: Preparation of Calcium Hydroxide

Calcium hydroxide was prepared by dissolving 350 g calcium nitrate in one liter DI water. 25 g of polyethylene glycol (average molecular weight=1,450) was added as a structure directing agent. A sodium carbonate/sodium hydroxide solution was prepared by adding 31 g of sodium carbonate and 60 g sodium hydroxide to 500 ml DI water in a Teflon beaker. The sodium carbonate/sodium hydroxide solution was then added to the calcium hydroxide solution while mixing. The pH of the calcium hydroxide solution was about 8, but rapidly increases to greater than 11 upon the addition of just a few drops of sodium hydroxide/sodium carbonate solution. The final pH of the solution was 12.4. A white precipitate formed upon addition of each drop of basic solution. The slurry was mixed for 30 minutes, then aged overnight at room temperature. In the morning, the solution was mixed, then filtered and washed 3 times with DI water. The product was dried at 80° C. overnight in a forced convection oven. The surface area of the sample was 29 $m^2/g$. The pore volume of the sample was 0.15 $cm^3/g$. Particle size was less than 40 mesh.

Example 16: Simulant Reactivity

The table below summarizes CEPS reactivity data recorded for selected porous metal hydroxides. Data were recorded by contacting 150 mg of porous metal hydroxide with 75 mg of CEPS (2:1 ratio), and by contacting 150 mg of porous metal hydroxide with 15 mg of CEPS (10:1 ratio). Data corresponding to a 2 hour contact time at 25° C. are summarized in the table below.

| Material | CEPS Conversion 2:1 ratio | CEPS Conversion 10:1 ratio |
|---|---|---|
| A-200-SiC1005S Reference | 17.5% | 28.2% |
| Silicon Hydroxide (eg 2) | 16.1% | 31.8% |
| Iron-Silicon Hydroxide (eg 6) | 34.0% | 83.1% |
| Aluminum Hydroxide (eg 3) | 14.2% | 28.1% |
| Silicon-Aluminum Hydroxide (eg. 5) | 19.0% | 53.0% |
| Iron-Silicon-Aluminum Hydroxide (eg. 10) | 23.4% | 48.9% |
| Cobalt-Zirconium Hydroxide (eg. 13) | 20.5% | 55.0% |

The table below summarizes DPPT reactivity data recorded for selected porous metal hydroxides. Data were recorded by contacting 150 mg of porous metal hydroxide with 75 mg of DPPT (2:1 ratio), and by contacting 150 mg of porous metal hydroxide with 15 mg of DPPT (10:1 ratio). Data corresponding to a 2 hour contact time at 25° C. are summarized in the table below.

| Material | DPPT Conversion 2:1 ratio | DPPT Conversion 10:1 ratio |
|---|---|---|
| A-200-SiC1005S Reference | 12.6% | 31.2% |
| Silicon Hydroxide (eg 2) | 16.4% | 45.1% |
| Iron-Silicon Hydroxide (eg 6) | 4.0% | 11.1% |
| Aluminum Hydroxide (eg 3) | 12.3% | 22.8% |
| Silicon-Aluminum Hydroxide (eg. 5) | 10.3% | 21.2% |
| Iron-Silicon-Aluminum Hydroxide (eg. 10) | 17.8% | 35.5% |
| Cobalt-Zirconium Hydroxide (eg. 13) | 15.0% | 30.1% |

Example 17: Simulant Surface Decontamination

The table below summarizes CEPS surface decontamination data recorded for selected porous metal hydroxides. Data were recorded by contacting a surface with 35 mg of CEPS, then decontaminating the surface using 75 mg of porous metal hydroxide (2:1 ratio), and by contacting the surface with 35 mg of CEPS, then decontaminating the surface using 150 mg of CEPS (4:1 ratio).

| Material | CEPS Conversion 2:1 ratio | CEPS Conversion 10:1 ratio |
|---|---|---|
| Silicon Hydroxide (eg 2) | >99% | >99% |
| Iron Silicon Hydroxide (eg 6) | 98.1% | >99% |
| Aluminum Hydroxide (eg 3) | 94.5% | 98.1% |
| Silicon-Aluminum Hydroxide (eg. 5) | 97.4% | >99% |
| Iron-Silicon-Aluminum Hydroxide (eg. 10) | >99% | >99% |
| Cobalt-Zirconium Hydroxide (eg. 13) | >99% | >99% |

Various modifications of the present invention, in addition to those shown and described herein, will be apparent to those skilled in the art of the above description. Such modifications are also intended to fall within the scope of the appended claims. It is appreciated that all reagents are obtainable by sources known in the art unless otherwise specified.

Patents, publications, and applications mentioned in the specification are indicative of the levels of those skilled in the art to which the invention pertains. These patents, publications, and applications are incorporated herein by reference to the same extent as if each individual patent, publication, or application was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A process of decontaminating a surface contaminated with at least one toxic agent, said process comprising:

contacting a porous co-metal hydroxide to a surface contaminated with at least one toxic agent, said porous co-metal hydroxide including at least two metals selected from the group consisting of silicon, aluminum, zirconium, iron, magnesium, cobalt, copper and calcium, and wherein said co-metal hydroxide includes at least one of silicon, aluminum and zirconium, and wherein said porous co-metal hydroxide kin the form of particles having a linear cross-sectional dimension of between about 50 nm to 100 μm.

2. The process of claim 1, wherein said porous co-metal hydroxide is selected from the group consisting of: iron-silicon hydroxide, iron-aluminum hydroxide, silicon-aluminum hydroxide, iron-silicon-aluminum hydroxide, magnesium-iron-silicon-hydroxide, cobalt-zirconium hydroxide, or mixtures thereof.

3. The process of claim 1, wherein said porous co-metal hydroxide has a surface area of 5 $m^2/g$ or greater.

4. The process of claim 1, wherein said porous co-metal hydroxide has a surface area of 200 $m^2/g$ or greater.

5. The process of claim 1, wherein said porous, co-metal hydroxide has a pore volume 0.1 $cm^3/g$ or greater.

6. The process of claim 1, wherein said porous co-metal hydroxide has a pore volume 0.5 $cm^3/g$ or greater.

7. The process of claim 1, further comprising, rinsing said surface with water, an organic solvent, or combinations thereof.

8. A process of decontaminating a surface contaminated with at least one toxic agent, said process comprising:

contacting a surface contaminated with at least one toxic agent with a sorbent consisting of a porous co-metal hydroxide, said porous co-metal hydroxide including at least two co-metals selected from the group consisting of silicon, aluminum, zirconium, iron, magnesium, cobalt, copper and calcium, and wherein said co-metal hydroxide includes at least one of silicon aluminum and zirconium, and wherein said porous, co-metal hydroxide is in the form of particles having a linear cross-sectional dimension of between about 50 nm to 100 pm.

9. The process of claim 8, wherein said, porous co-metal hydroxide Is selected from the group, consisting of: iron-silicon hydroxide, iron-aluminum hydroxide, silicon-aluminum hydroxide, iron-silicon-aluminum hydroxide, magnesium-iron-silicon hydroxide, cobalt-zirconium hydroxide, or mixtures thereof.

10. The process of claim 8, wherein said porous co-metal hydroxide has a surface area of 5 $m^2/g$ or greater.

11. The process of claim 8, wherein said porous co-metal hydroxide has a pore volume 0.1 $cm^3/g$ or greater.

12. The process of claim 8, wherein said toxic agent is selected from the group consisting of pinacolyl methylphosphonofluoridate (GD), tabun (GA), sarin (GB), cyclosarin (GF), O-ethyl S-(2-diisopropylamino)ethyl methylphosphonothioate (VX), bis-(2-chloroethyl)sulfide (HD), analogs or derivatives of the forgoing, and an insecticide selected from parathion, paraoxon, and malathion.

* * * * *